United States Patent [19]

Kothe

[11] 4,192,980

[45] Mar. 11, 1980

[54] AUTOMATIC RE-SET PRESSURE SWITCH

[75] Inventor: Erich Kothe, Schaumburg, Ill.

[73] Assignee: The Singer Company, New York, N.Y.

[21] Appl. No.: 947,997

[22] Filed: Oct. 2, 1978

[51] Int. Cl.[2] ..... H01H 35/34

[52] U.S. Cl. ..... 200/83 WM; 200/83 L; 200/322; 337/118

[58] Field of Search ..... 337/117, 118, 320; 200/83 WM, 83 R, 83 L, 83 Z, 83 P, 83 S, 61.2, 323-325, 318, 321, 322

[56] References Cited

U.S. PATENT DOCUMENTS

| | | | |
|---|---|---|---|
| 3,291,932 | 12/1966 | Main | 200/83 WM |
| 3,315,053 | 4/1967 | Bauer | 200/83 WM |
| 3,319,023 | 5/1967 | Lake | 200/83 WM |

*Primary Examiner*—Gerald P. Tolin

[57] ABSTRACT

If the pressure switch pre-loading cam has been set for a level above medium the pressure switch is returned to medium after completion of the wash cycle by momentary energization of the solenoid to unlatch the slider from the lobed cam. The slider carries the high and extra high settings and when it is disconnected from the cam the torsion spring on the cam shaft can drive the cam back to medium by pushing the slider out of the way. This arrangement prevents inadvertent repeated use of the higher water level settings, thus preventing inadvertent use of hot water.

10 Claims, 8 Drawing Figures

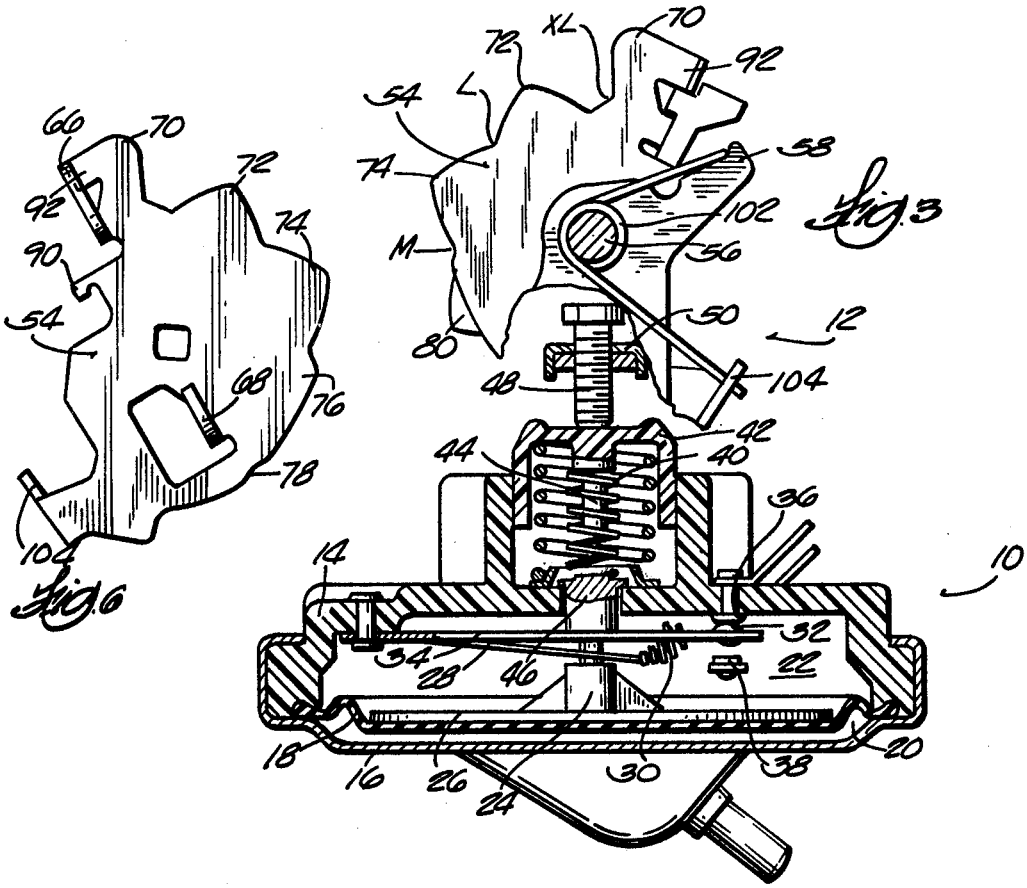
Fig. 3
Fig. 6
10
12
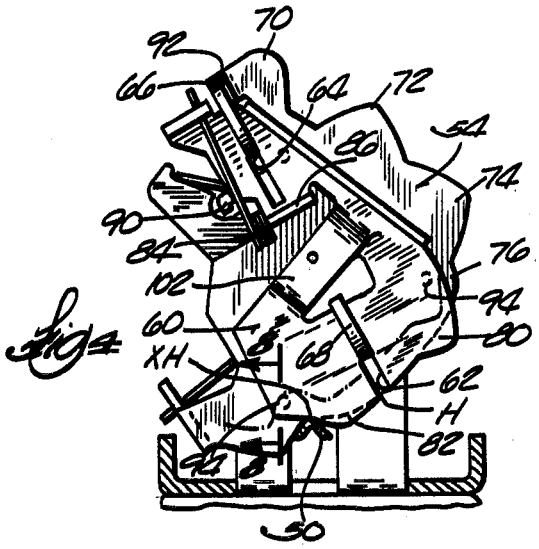
Fig. 4
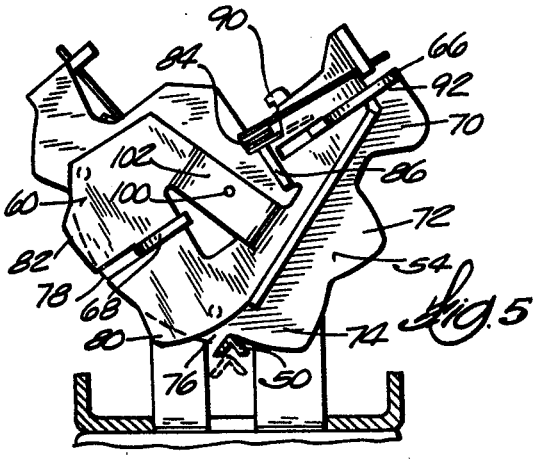
Fig. 5
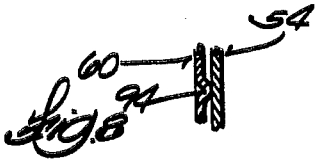
Fig. 8
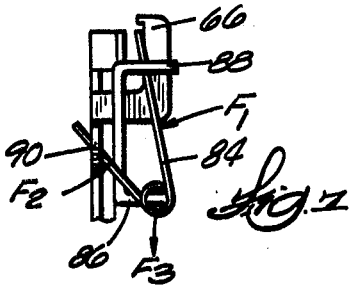
Fig. 7

AUTOMATIC RE-SET PRESSURE SWITCH

BACKGROUND OF THE INVENTION

Generally a medium fill of a washing machine is adequate for the load being washed. If the user selects a high or extra high fill the tendency is to forget to reset to a lower fill on subsequent cycles, thus wasting hot water. It is desired to have the pressure switch automatically reset to medium on completion of a cycle in which high or extra high has been selected.

The pressure switch uses a multi-lobed cam for selecting the various water levels (the lobes between each setting serving to positively reset the switch). To drive such a cam requires considerable force and this suggests two approaches. The first would be a solenoid which is fast acting but to get enough force and stroke a large solenoid would be required and thus becomes too costly.

A large force and stroke can be obtained with a heated wax motor but that sort of device operates too slowly for serious consideration. A different approach is dictated.

The problem is new and no prior art is known.

SUMMARY OF THE INVENTION

The primary object of this invention is to provide, at reasonable cost, a pressure switch which is manually settable to select various water levels and which can be quickly reset to a medium level.

In carrying out this invention, I have in effect made the usual multi-lobe cam in two parts, one of which is slideably mounted on the main cam for movement to a position in which it is out of the way and allows the main cam to return to medium but which is normally latched relative to the main cam to permit customary selection of high and extra high levels. The slide is unlatched by a small solenoid which is energized by a momentary closure of a switch incorporated in a timer. Operation and setting of the pressure switch is completely "normal" at level settings of medium and below.

DESCRIPTION OF THE DRAWINGS

FIG. 3 is a vertical section with parts broken away.

FIG. 4 is a detailed view of the cam in the extra high setting.

FIG. 5 is similar to FIG. 4 showing the medium position of the cam.

FIG. 6 is a detail of one of the two cams which make up the composite cam.

FIG. 7 is a detail of the spring biasing the slider-cam.

FIG. 8 is a detail of one of the dimples which make up the pivot axis for the slider-cam.

DETAILED DESCRIPTION OF THE DRAWINGS

Figure 1:
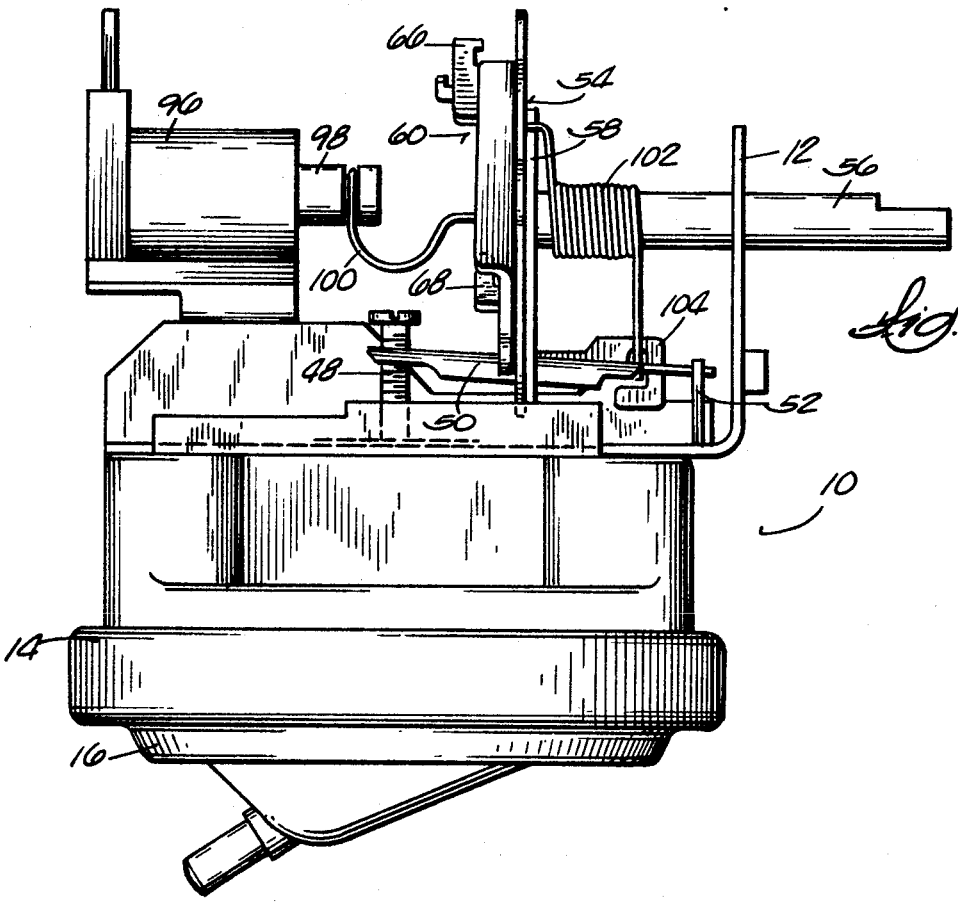
FIG. 1 is a side elevation of the device.
Figure 2:
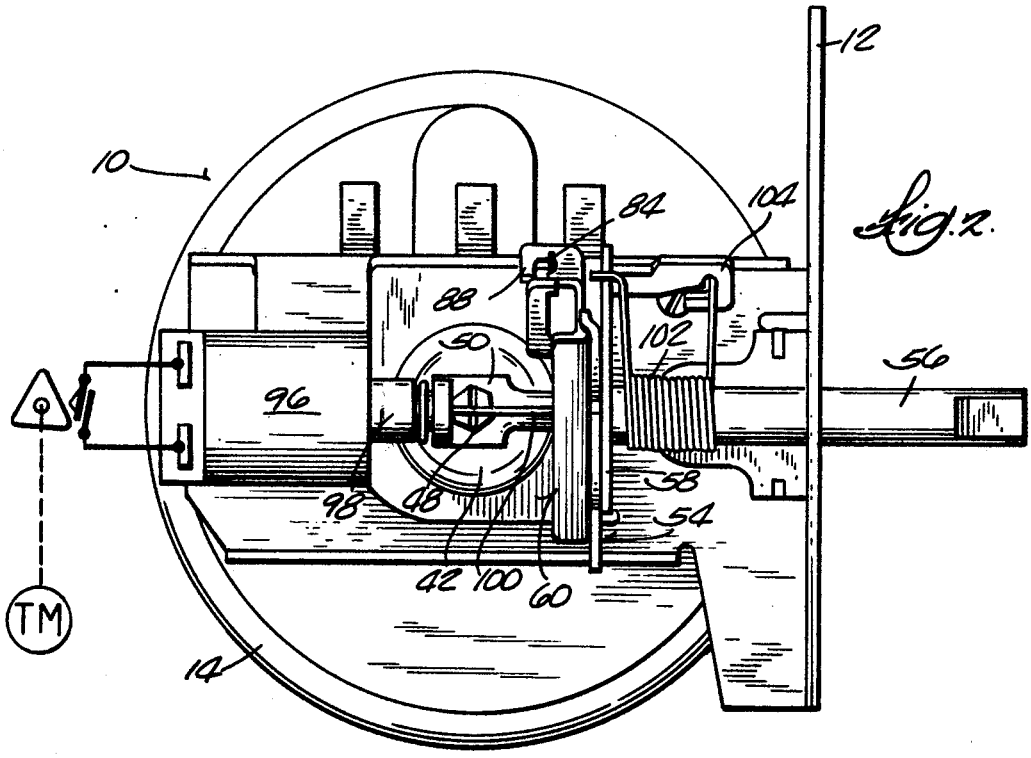
FIG. 2 is a top plan view.

Since the details of the pressure switch are not important to understanding the invention, the pressure switch mechanism will be described only to the extent necessary to understand the setting and resetting mechanism. The pressure switch is contained in housing 10 fixed to bracket 12 and comprising cover 14 and the lower cup 16 secured thereto with the periphery of diaphragm 18 captured therebetween to define a pressure chamber 20 and a switch chamber 22. The switch actuator 24 projecting from the center of diaphragm pad 26 actuates the switch tongue 28 and when the tongue has moved far enough the barrel spring 30 goes over center and moves the contact 32 on the end of blade 34 from the contact 36 to contact 38. The force necessary to actuate the switch is determined by the degree of compression of spring 40 and that is determined by the position of plunger 42 projecting through the aperature of the cover. It should be noted that the switch can be reset after trip by depressing the plunger 42 far enough so the pin 44 on the underside of the plunger engages and moves pad 46 which, in turn, pushes the actuator 24 and tongue 28 back over center to reset the switch.

The foregoing is old. This invention is concerned with the level selection mechanism and the automatic resetting of the selection mechanism to the medium level position following a cycle in which high or extra high was selected.

The force necessary to trip the switch is, as noted above, determined by the initial setting of the plunger and this is determined by the calibrating screw 48 engaging the top of the plunger and threadably mounted in lever 50 which is pivoted on the bracket at 52. The position of the lever therefore determines the level selection. The position of the lever is determined by what might be termed a composite cam comprised of a cam 54 fixed on shaft 56 which is journaled in the bracket 12 and in the parallel plate 58. This is the principal cam determining the position of lever 50 and has a slider 60 slidably mounted on the cam for reciprocal motion. Thus the slider is provided with two slots 62, 64 which respectively fit over the two hook-like tabs 66, 68 projecting from the cam. It will be noted that the cam 54 is provided with multiple lobes 70, 72, 74 and a minor lobe 76. The periphery of the cam is somewhat stepped up in the region of 78. The slider is biased to an outer position determined by the engagement of the end of slot 62 with tab 68. In the outer position lobes 80 and 82 on the slider project beyond that portion of the cam lying generally counterclockwise from the minor lobe 76.

This bias is obtained by means of the light coiled spring 84 mounted on finger 86 formed from the slider with the spring stressed in the unwinding direction so that the long end fitting under tab 88 at the end of the slider exerts a force F1 on the tab pushing the slider inwardly while the short end of the spring 84 fits under finger 90 formed on cam 54. This results in a force F2 being exerted on the finger 90 in the direction indicated while the force F1 of the long end of the spring is exerted in the direction indicated. The resultant force F3 on the post 86 on which the coil spring is mounted is in the direction indicated pushing the slider to project its lobes as indicated above. Thus, this single light spring serves two purposes. One is to bias the slider towards the cam 54 and the other is to bias the slider to project its lobes beyond the perimeter of the cam 54.

When in the projected position and when so biased towards the cam, the outer end of the slider (i.e. near finger 88) is inwardly of the keeper 92 formed from the cam 54. Thus the slider is latched in place. To unlatch the slider, it is necessary to pull the slider away from the cam and free of the keeper. It will be noted the slider is formed with two spaced dimples 94, 94 projecting towards the cam and these constitute the pivot axis about which the slider can be rocked when the slider is disengaged from the keeper.

The slider is disengaged from the keeper and freed for sliding motion retracting the slider lobes so they no longer project beyond the perimeter of cam 54 by actuation of the small solenoid 96 mounted on the bracket. When the solenoid coil is energized, the armature 98 is pulled into the coil and the formed linkage 100 connected between the armature and the raised pad 102 on the slider pulls on the slider to disengage the slider from the keeper. A further feature of this action is the fact that the coil axis is somewhat above the axis of shaft 56 and the connecting point of the linkage to the pad 102. Therefore, when the armature pulls into the coil, it not only will pull the slider to rock it about the dimples 94 but it will also exert an upward force component clearing the end of the slider from the latch after it has been retracted from the latch.

Now, considering the various settings which can be selected, it should be first noted that the lobe 70 is sort of a limit stop while the lobes 72 and 74 as well as lobes 80 and 82 serve as reset lobes which act on the lever, to push the plunger down far enough to reset the switch. Now then, on the main cam 54 there is an "extra low" depression or valley XL between lobes 70 and 72. The "low" setting is at the valley L with the "medium" setting M at the slight notch adjacent point 76 on cam 54. The "high" position is that designated H while the "extra high" position, XH, is radially the greatest distance from the rotation axis of cam 54. All of these positions from "extra low" through "extra high" involve increasing the preload of the pressure switch spring. During the selection operation, the slider and cam move as a unit and function as a single cam unit since the slider is latched relative to the cam.

It will be noted that a coiled torque spring 102 is fixed on shaft 56 with one end engaging finger 104 projecting from cam 54. The other end of the spring 102 is bent and can engage either the plate 58 or can engage the cam 54. The spring is stressed in the unwinding direction so as to exert a force in the counterclockwise direction on finger 104 when viewed from the outer end of the shaft. This spring does absolutely nothing at all settings from "medium" to "extra low" since, in all of those settings, both ends of the spring bear on cam 54, the bent end bearing directly on the cam plate and the other end bearing on finger 104. As the cam assembly is rotated to select either "high" or "extra high", the bent end of the spring engages plate 58 and now the spring force acting on finger 104 is not cancelled out. Therefore, as the cam is moved towards "high" and "extra high" there is a force exerted on the cam biasing the cam towards medium position. This restoring force is not sufficient to drive the cam assembly back to medium since the force of engagement of the lever with the lobes on the slider (which is now latched relative to the cam) is great enough to resist this return motion. However, when the solenoid is energized to unlatch the slider, the restoring force exerted by the torque spring 102 can override the very slight bias imposed by spring 84 on the slider and the slider gets pushed out of the way with the substantially smooth contour 78 of the cam riding on the lever and offering no resistance. This then allows the torque spring 102 to drive the cam 54 back to the medium position. At that position the torque spring is engaged by the cam and, in effect, the spring forces are cancelled out and there is no further drive force exerted on the cam 54. Therefore the cam stops at the "medium" position. Any misalignment with the "medium" position will automatically be adjusted for by the force of the lever acting on the cam perimeter driving it to the point of least resistance which is the small valley adjacent the minor lobe 76.

It should be understood that the reset lobes could be eliminated between the cam settings below the medium or normal setting while retaining the cam lobes above that setting simply for the purpose of preventing return of the cam from higher settings until the slider is unlatched. Thus, a key purpose of the slider lobes is to prevent movement of the cam back to the medium setting until the slider is unlatched to permit the lobes to be pushed out of the way and the cam to return under influence of the torque spring.

I claim:

1. In combination with a pressure switch having a switch actuated by a diaphragm moved by pressure against the pre-load force of a spring which is seated against a member positioned by means of manually actuateable and settable cam means to provide for various pre-load forces on the spring corresponding to values above and below a medium value, the improvement of, means biasing the cam means back to the medium setting from settings above medium, and providing means operative to prevent movement of the cam means under influence of the biasing means and moveable to a position allowing the cam means to move back to the medium setting, and means for moving the preventing means to said position.

2. The improvement of claim 1 in which the preventing means is mounted on the cam means and is normally latched in operative position, and said moving means includes means for unlatching the preventing means.

3. The improvement of claim 2 in which the preventing means projects beyond the cam means and engages said member to prevent cam means movement under the force exerted by the biasing means, said cam means being manually actuateable in all positions.

4. The improvement of claim 3 in which the cam means is rotatable and the preventing means is carried by a slider reciprocably mounted on the cam means for movement between said operative position and a retracted position in which the preventing means are free to move to an inoperative position leaving the cam means free to move under influence of the biasing means back to the medium setting.

5. The improvement of claim 4 in which the biasing means is effective only at pre-load settings above medium and comprises a coiled torque spring having both ends bearing on the cam means at the medium setting and lower settings but having one end bearing on a fixed anchor above the medium setting while the other end bears on the cam means and the biasing force increases as the cam means is rotated to higher settings.

6. The improvement of claim 5 including spring means biasing the slider to said operative position.

7. The improvement of claim 6 in which said unlatching means includes a solenoid having its armature connected to said slider to unlatch the slider when the solenoid is energized.

8. The improvement of claim 7 in which the preventing means comprises a reset lobe on the slider projecting beyond the cam means when the slider is in operative position, said lobe being operative to actuate the member against which the pre-load spring is seated so as to enable a reset pin carried by such member to actuate the switch, said lobe being positioned between predetermined positions of the cam means providing different pre-load settings.

9. The improvement of claim 8 in which the cam means is provided with a plurality of reset lobes between the medium cam surface and those cam surfaces providing pre-load settings below medium.

10. In combination with a pressure switch having a switch actuated by a diaphragm moved by pressure against the pre-load force of a spring which is seated against a member positioned by means of manually actuateable and settable cam means to provide for various pre-load forces on the spring corresponding to values above and below a medium value, the improvement of, means biasing the cam means back to the medium setting from settings above medium, means for latching the cam means in any setting above the medium setting, and means for releasing the latch means to enable the cam means to return to the medium setting under influence of said biasing means.

* * * * *